United States Patent [19]

Halpern

[11] 4,402,354

[45] Sep. 6, 1983

[54] SHARPENER FOR COSMETIC PENCILS

[76] Inventor: Judith Halpern, 1641-35 Third Ave., New York, N.Y. 10028

[21] Appl. No.: 406,693

[22] Filed: Aug. 9, 1982

[51] Int. Cl.[3] ..... B43L 23/00

[52] U.S. Cl. ..... 145/3.5; 145/3.1; 145/3.31; 145/3.61

[58] Field of Search ..... 145/3.5, 3.31, 3.61, 145/3.1

[56] References Cited

U.S. PATENT DOCUMENTS 4,248,283 2/1981 Kaye ..... 145/3.61

FOREIGN PATENT DOCUMENTS 205563 9/1939 Switzerland ..... 145/3.5

665048 1/1952 United Kingdom ..... 145/3.5

979927 1/1965 United Kingdom ..... 145/3.5

*Primary Examiner*—Harold D. Whitehead

*Assistant Examiner*—J. T. Zatarga

*Attorney, Agent, or Firm*—Sprung, Horn, Kramer & Woods

[57] ABSTRACT

A sharpener for cosmetic pencils comprises a housing sharpening unit disposed in the housing and receptive of at least one size cosmetic pencil for sharpening same and including at least one metal blade and a solid state thermoelectric cooling device disposed adjacent said sharpening unit and at least indirectly thermally contacting the blade. The cooling device is selectively electrically energized to cool the sharpening unit and thereby the pencil point.

9 Claims, 4 Drawing Figures

SHARPENER FOR COSMETIC PENCILS

BACKGROUND OF THE INVENTION

The present invention relates to a sharpener for cosmetic pencils and the like.

Although sharpeners for cosmetic pencils are known in the art, whether these sharpeners have the disadvantage of constantly breaking the cosmetic pencil point during the sharpening operation because of the softness of the cosmetic material under ambient temperature conditions.

While many cosmetic manufacturers advise leaving the cosmetic pencil in the refrigerator when not in use or prior to sharpening, this is clearly impractical or impossible when one is traveling, when one is at work or when one is out of one's home in general.

SUMMARY OF THE INVENTION

The main object of the present invention is to overcome the disadvantages of the known cosmetic pencil sharpeners and to provide a simple and portable sharpener which can cool the cosmetic pencil material prior to the sharpening thereof without the need for prior refrigeration.

Another object of the present invention is to provide a sharpener which can be used with different size cosmetic pencils and which can cool and sharpen any of various size pencils with the need of modification.

These and other objects and advantages of the present invention will become clearer from the following disclosure of the preferred embodiments thereof taken in conjunction with the attached drawings, wherein:

DETAILED DESCRIPTION OF THE PREFERRED EMBODIMENTS

Figure 1:
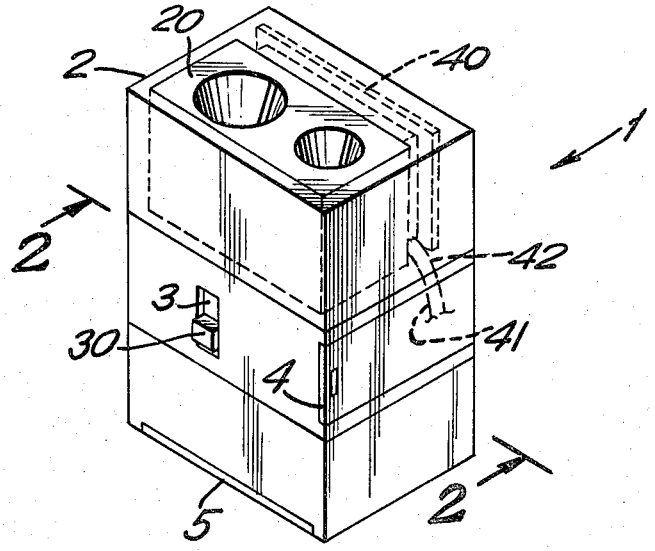
FIG. 1 is a plan view of the sharpener according to the present invention.
Figure 2:
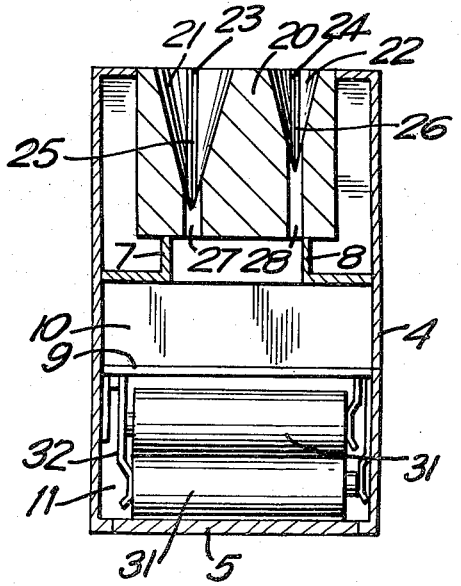
FIG. 2 is a sectional view of the sharpener of FIG. 1.
Figure 3:
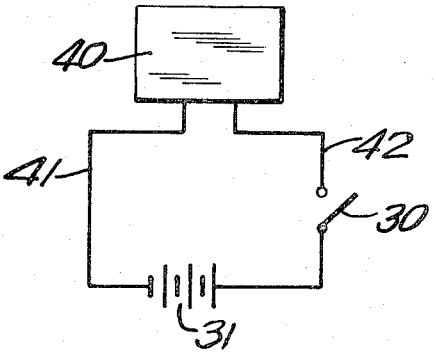
FIG. 3 is a schematic of the circuit used in the sharpener of FIG. 1.

Referring now to FIGS. 1–3, the sharpener 1 includes a plastic housing 2, the top wall 2*a* of which has an aperture 6 therein for receiving a pencil sharpener unit 20 which will be described hereinafter. The sharpener unit 20 is closely received within the aperture 6 and is seated on flange portions 7 and 8 so that the top thereof is flush with the surface of the top wall 2*a*.

The body 2 also has an aperture 3 for receiving a sliding switch 30 and has sliding compartment doors 4 and 5 which are used to access the waste compartment 10 and the battery compartment 11, respectively.

Also disposed within the housing, adjacent to the sharpener unit 20 is a thermoelectric cooling device 40 which for example can be a Borg-Warner thermoelectric module, model number 110–12. Thermoelectric cooling devices of this type are small heat pumps which use semiconductor materials to pump heat from a cold junction to a hot junction in response to the application of electric current thereto.

As shown in FIG. 3, the thermoelectric cooling device 40 is connected via its leads 41 and 42 to a source of electricity, in particular batteries 31, through switch 30. When switch 30 is closed, current is allowed to be fed to the thermoelectric device which is positioned so that the cold junction thereof abuts the sharpening unit 20. When the switch 30 is opened, the device 40 discontinues cooling. In this matter, the cooling is obtained only as desired and for the period desired.

It is clear that the use of batteries 31 which are disposed in battery holder 32 held in compartment 11 and accessible through door 5 is preferred for portable use. However, it is well within the ambit of those skilled in the art to convert such a device to use an A/C voltage source, or to permit the recharging of the batteries when the user is at home.

The sharpener unit 20 may be a conventional unit formed in a metal body composed of aluminum or the like having two generally conical bores 21, 22 therein which have a maximum diameter of approximately ½" and 5/16" respectively. These bores, as in conventional sharpeners of this type, have slots 23, 24 along a generatrix of each and a blade edge 25, 26 extending through the slots and into the bores so as to contact a pencil during use. Conventional cosmetic pencils are made in two sizes corresponding to the above-mentioned sizes of the conical bores 21, 22. The unit 20 can be removed from housing 2 to permit the sharpening of edges 25, 26 or the replacement of the entire unit by another.

The cooling unit 40 preferably abuts the blades 25, 26 so as to cool same, however, it is also preferred that the sharpener body 20 comprise thermally conductive material such as aluminum and the like so that the entire sharpener unit will be cooled thereby cooling the leading edge of the cosmetic pencil when placed therein.

Waste material coming from the sharpened pencil falls through apertures 27, 28 and into the waste compartment 10 which can be emptied by opening door 4 in housing 2.

Figure 4:
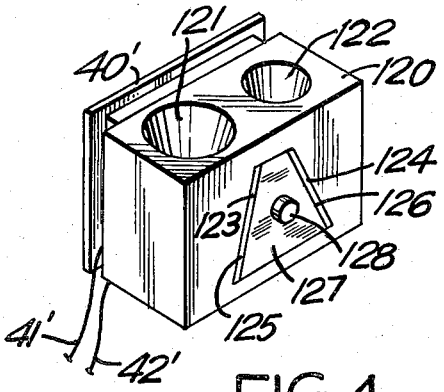
FIG. 4 is a plan view of an alternative embodiment of the sharpening module according to the present invention.

In the embodiment shown in FIG. 4, the cooling device 40' abuts directly against the sharpener body 120 and indirectly cools the sharpening blade 127, which in the embodiments shown is a single blade having two edges 125, 126 which extend into the slots 123, 124 of bores 121 and 122. The blade 127 is held in place by a screw element 128.

It will be appreciated that the instant specification and claims are set forth by way of illustration and not limitation, and that various modifications and changes may be made without departing from the spirit and scope of the present invention.

What is claimed is:

1. A sharpener for cosmetic pencils comprising:

a housing;

sharpening means disposed in said housing and receptive of at least one size cosmetic pencil for sharpening same, wherein said sharpening means includes at least one metal blade;

a solid state thermoelectric cooling device disposed adjacent said sharpening means and at least indirectly thermally contacting said blade; and means for selectively effecting electrically energization of said cooling device to cool at least said blade.

2. The sharpener according to claim 1, wherein the energizing means comprises at least one battery disposed in the housing and a selectively actuatable switch for electrically connecting the battery to the cooling device.

3. The sharpener according to claim 1, wherein the sharpening means comprises a body portion including at least one conical bore with a slot along a generatrix thereof and wherein the blade edge extends parallel to the generatrix of the bore and through the slot and into the bore.

4. The sharpener according to claim 3, wherein the body portion includes two conical bores having maximum diameters of about 5/16" and ½" respectively.

5. The sharpener according to claim 4, wherein the blade has two edges, each lying parallel to the generatrix of one conical bore and extending into that bore.

6. The sharpener according to claim 4, wherein the sharpening means comprises two blades, each associated wit one bore.

7. The sharpener according to claim 3, wherein the housing comprises a waste compartment below the body portion of the sharpening means.

8. The sharpener according to claim 3, wherein the body portion is composed of plastic and the cooling device has one surface abutting said blade.

9. The sharpener according to claim 3, wherein the body portion is composed of metal and the cooling device has one surface abutting same.

* * * * *